US008960854B2

(12) United States Patent
Izawa et al.

(10) Patent No.: US 8,960,854 B2
(45) Date of Patent: Feb. 24, 2015

(54) INKJET RECORDING APPARATUS

(71) Applicants: Hideo Izawa, Narashino (JP); Akira Ishikawa, Narashino (JP); Yuuichi Yamazaki, Narashino (JP); Kouichi Ooyama, Yokote (JP); Masahito Sato, Yokote (JP)

(72) Inventors: Hideo Izawa, Narashino (JP); Akira Ishikawa, Narashino (JP); Yuuichi Yamazaki, Narashino (JP); Kouichi Ooyama, Yokote (JP); Masahito Sato, Yokote (JP)

(73) Assignee: Miyakoshi Printing Machinery Co., Ltd., Narashino-shi, Chiba (JP)

( * ) Notice: Subject to any disclaimer, the term of this patent is extended or adjusted under 35 U.S.C. 154(b) by 0 days.

(21) Appl. No.: 13/706,628

(22) Filed: Dec. 6, 2012

(65) Prior Publication Data

US 2013/0215198 A1 Aug. 22, 2013

(30) Foreign Application Priority Data

Feb. 20, 2012 (JP) ..... 2012-033646

(51) Int. Cl.

| | |
|---|---|
| ***B41J 2/15*** | (2006.01) |
| ***B41J 2/14*** | (2006.01) |
| ***B41J 23/02*** | (2006.01) |
| ***B41J 25/00*** | (2006.01) |
| ***B41J 25/34*** | (2006.01) |
| ***B41J 29/02*** | (2006.01) |

(52) U.S. Cl.

CPC ..... *B41J 2/1433* (2013.01); *B41J 23/025* (2013.01); *B41J 25/001* (2013.01); *B41J 25/34* (2013.01); *B41J 29/02* (2013.01)

USPC ..... 347/40

(58) Field of Classification Search

CPC ..... B41J 11/20; B41J 2/16547; B41J 2002/16502; B41J 2/14024; B41J 2/155; B41J 2/0458; B41J 2/2128; B41J 2/16508

USPC ..... 347/12, 14, 15, 29, 32, 40, 104

See application file for complete search history.

(56) References Cited

U.S. PATENT DOCUMENTS

| | | | | |
|---|---|---|---|---|
| 6,293,650 | B1 * | 9/2001 | Sette et al. | 347/37 |
| 6,318,840 | B1 * | 11/2001 | Sette et al. | 347/37 |
| 6,367,910 | B1 * | 4/2002 | Sette et al. | 347/37 |
| 2006/0028505 | A1 * | 2/2006 | Ikegame | 347/40 |
| 2006/0103707 | A1 * | 5/2006 | Askeland et al. | 347/101 |
| 2009/0189943 | A1 * | 7/2009 | Taira et al. | 347/20 |
| 2009/0244124 | A1 * | 10/2009 | Kondo | 347/8 |
| 2010/0245477 | A1 * | 9/2010 | Ohkubo et al. | 347/47 |
| 2011/0122184 | A1 * | 5/2011 | Kimura et al. | 347/14 |
| 2011/0134190 | A1 * | 6/2011 | Mase et al. | 347/54 |
| 2012/0044296 | A1 * | 2/2012 | Gouch et al. | 347/40 |

* cited by examiner

*Primary Examiner* — Matthew Luu
*Assistant Examiner* — Patrick King
(74) *Attorney, Agent, or Firm* — Flynn, Thiel, Boutell & Tanis, P.C.

(57) ABSTRACT

An inkjet recording apparatus 10 includes a first plate 20*a* having line heads 11*a* aligned thereon, a coupling portion 21 jointed to the first plate 20*a*, a drive device 30 sliding the first plate 20*a* via the coupling portion 21 from a waiting position P1 in which the line heads wait to a recording position P2 in which recording is performed on a recording medium 1, and a second plate 20*b* having at least one line head 11*b* thereon and being attachable to and detachable from the coupling portion 21, wherein only the first plate 20*a* is slidable when the second plate 20*b* is detached from the coupling portion 21, and the first plate 20*a* and the second plate 20*b* are integrally slidable when the second plate 20*b* is attached to the coupling portion 21.

4 Claims, 7 Drawing Sheets

INKJET RECORDING APPARATUS

TECHNICAL FIELD

The present invention relates to an inkjet recording apparatus, and in particular to an inkjet recording apparatus capable of preventing nozzle clogging, aligning nozzle positions of line heads precisely and easily and adjusting the number of line heads.

BACKGROUND ART

A line head type inkjet recording apparatus is used in many fields because of its capability of high-speed continuous recording of designs or letters based on predetermined image data.

In recent years, in addition to four colored inks of yellow (Y), magenta (M), cyan (C), and black (K) (called "YMCK"), such an inkjet recording apparatus simultaneously provides value-added special inks, such as an ink having an intermediate color between these colors, a fluorescent color ink or an ink having a weather-resistant agent.

In addition, accordingly, many inkjet recording apparatuses having an increased number of line heads have been developed.

By the way, in an inkjet recording apparatus, generally, the frequencies of respective inks to be used are different largely according to image data. Therefore, for example, an unused special ink might dry and solidify in a nozzle portion of a line head while inkjet recording is being performed using other inks. Then, the nozzle portion clogs up, and it takes time to clear the clogged nozzle.

On the other hand, in order to suppress drying of an ink, for example, such a method is used as temporarily detaching a line head containing an unused ink or moving the same so as to wait in another position.

However, the positions of the nozzles of the line heads need to be finely aligned with a micron unit, and therefore, once the line head is moved, there is the disadvantage that it becomes difficult to perform pitch alignment when the line head is put back to its original position.

It should be noted that as an inkjet recording apparatus capable of preventing the drying of an unused ink, there is a known inkjet recording apparatus including a black print head, a color print head, a black print head cap to close a nozzle of the black print head, a color print head cap formed as a separate member from the black print head cap and closing a nozzle of the color print head, a black cap moving means for moving the black print head cap between a closing position where the nozzle of the black print head is closed and a retracting position where the nozzle is opened, and a color cap moving means for moving the color print head cap between a closing position where the nozzle of the color print head is closed and a retracting position where the nozzle is opened (for example, see the patent literature 1). According to such an inkjet recording apparatus, by capping a nozzle of an unused color print head during ejection of a black ink to perform printing, an ink in the nozzle can be prevented from drying.

CITATION LIST

Patent Literature

PTL 1: Japanese Patent No. 3670428

SUMMARY OF INVENTION

Technical Problem

In the inkjet recording apparatus described in the above patent literature 1, for example, it is impossible to add a line head ejecting the above special ink.

In addition, in the inkjet recording apparatus described in the above patent literature 1, clogging with ink can be suppressed, but it is difficult to align the positions of the nozzle portions of the line heads. That is, generally, when recording is performed with YMCK, it is necessary to align the nozzle positions of the respective colors finely but, in the inkjet recording apparatus described in the above patent literature 1, since a drive system for the black print head and a drive system for the color print head are different from each other, in the case of full-color inkjet recording, there is the possibility of misalignment between the nozzle position of the black print head and the nozzle position of the color print head.

Therefore, an inkjet recording apparatus is desired which is capable of aligning the positions of the nozzles easily after the line head is moved in order to prevent the nozzle portion from being clogged.

In view of these circumstances, the present invention has been made and an object thereof is to provide an inkjet recording apparatus capable of preventing nozzle clogging, aligning the nozzle positions of the line heads precisely and easily and adjusting the number of line heads.

Solution to Problems

The present inventor has made intensive researches to solve the above problems, has found that the above problems can be solved by providing a second plate in addition to a first plate and driving the first plate, or the first plate and the second plate, by a single drive shaft and has completed the present invention.

A first aspect of the present invention lies in an inkjet recording apparatus including a first plate having a plurality of line heads arranged thereon, a coupling portion jointed to the first plate, a drive device sliding the first plate via the coupling portion from a waiting position in which the line heads wait to a recording position in which recording is performed on a recording medium, and a second plate having at least one line head arranged thereon and being attachable to and detachable from the coupling portion, wherein only the first plate is slidable when the second plate is detached from the coupling portion, and the first plate and the second plate are integrally slidable when the second plate is attached to the coupling portion.

A second aspect of the present invention lies in the inkjet recording apparatus according to the above first aspect, further including a main body frame, and a first rail and a second rail attached to the main body frame, wherein the first plate slides along the first rail, and the second plate slides along the second rail.

A third aspect of the present invention lies in the inkjet recording apparatus according to the above first or second aspect, wherein the second plate and the coupling portion are attached to each other at two points.

A fourth aspect of the present invention lies in the inkjet recording apparatus according to the above first or second aspect, wherein a pair of first coupling pin holes is formed in the coupling portion, a pair of second coupling pin holes is formed in the second plate, and the position of the second plate is determined in relation to the first plate by fitting coupling pins into the corresponding first and second coupling pin holes aligned with each other.

A fifth aspect of the present invention lies in the inkjet recording apparatus according to any one of the above first to fourth aspects, wherein the drive device is composed of a ball screw composed of a nut portion provided to the coupling portion and a screw shaft on which the nut portion slides, and a drive motor rotating the screw shaft.

A sixth aspect of the present invention lies in the inkjet recording apparatus according to any one of the above first to fifth aspects, wherein four line heads containing respective inks of YMCK are arranged on the first plate.

A seventh aspect of the present invention lies in the inkjet recording apparatus according to the above sixth aspect, wherein two rows of heads are arranged for each of the line heads of the first plate.

An eighth aspect of the present invention lies in the inkjet recording apparatus according to any one of the above first to seventh aspects, wherein the waiting position is provided with a cap attachable to nozzle portions of the line heads.

Advantageous Effects of Invention

In the inkjet recording apparatus of the present invention, since the second plate having at least one line head arranged thereon is provided in addition to the first plate having a plurality of line heads arranged thereon, the number of the line heads can be adjusted.

For example, such a configuration can be adopted that four line heads containing respective inks of YMCK are arranged on the first plate, while any number of line heads containing a special ink are arranged on the second plate.

In the inkjet recording apparatus of the present invention, since only the first plate slides when the second plate is detached from the coupling portion, and the first plate and the second plate slide integrally when the second plate is attached to the coupling portion, the number of the line heads to be used can be adjusted according to image data.

In addition, the first plate, or the first plate and the second plate can be driven by the same drive shaft. That is, since the drive shaft is one in number, the nozzle position of the line head of the first plate and the nozzle position of the line head of the second plate can be prevented from deviating from each other. In this regard, it is preferred that the second plate is attached at two points to the coupling portion jointed to the first plate. According to this means, it is possible to align the nozzle positions of the line heads more precisely and easily.

In the inkjet recording apparatus of the present invention, when the main body frame, and the first rail and the second rail attached to the main body frame are further included, and the first plate slides along the first rail and the second plate slides along the second rail, it is possible to slide the first plate and the second plate smoothly.

In the inkjet recording apparatus of the present invention, when the position of the second plate is determined in relation to the first plate by fitting the coupling pins into the corresponding first and second coupling pin holes aligned with each other, it is possible align the nozzle positions of the line heads still more precisely and easily.

In the inkjet recording apparatus of the present invention, when two rows of heads are arranged for each of the line heads of the first plate, it is possible to perform high-speed inkjet recording, or to increase resolution.

In the inkjet recording apparatus of the present invention, when the drive device sliding the first plate is composed of the ball screw and the drive motor, it is possible to dispose the first plate in a desired position precisely.

In the inkjet recording apparatus of the present invention, when the waiting position is provided with a cap attachable to nozzle portions of the line heads, it is possible to dispose an unused line head in the waiting position and cover the nozzle portions with the cap. This makes it possible to prevent the ink contained in the line head from drying, thereby preventing the nozzle portions from clogging.

DESCRIPTION OF EMBODIMENTS

Figure 1:
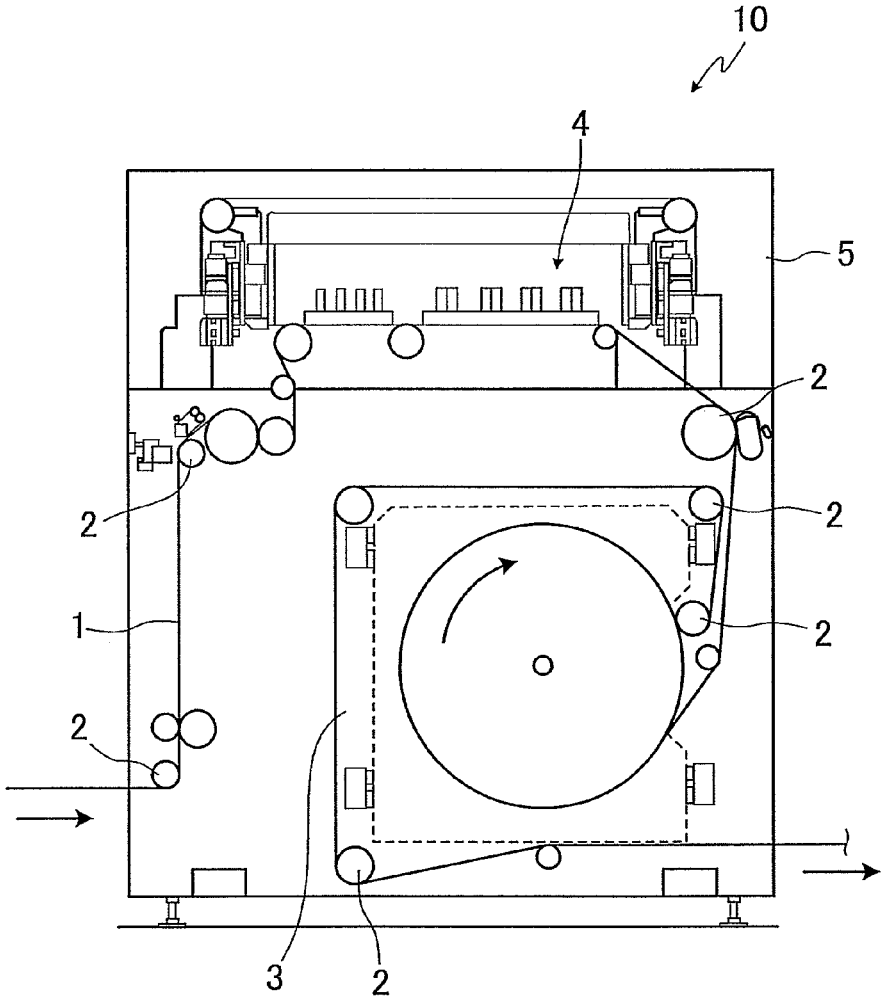
FIG. 1 is a front view schematically showing an inkjet recording apparatus according to an embodiment of the present invention.

Hereinafter, with reference to the drawings, if necessary, a preferred embodiment of the present invention will be described in detail. It should be noted that in the Figures, identical elements are denoted by identical reference signs in order to omit repeated description. In addition, positional relations, such as top, bottom, right and left, are based on the drawings, unless otherwise noted. Furthermore, the ratios of dimensions of an element are not limited to those shown in the drawings.

FIG. 1 is a top view schematically showing an inkjet recording apparatus according to the embodiment.

As shown in FIG. 1, an inkjet recording apparatus 10 according to the embodiment is of a line head type provided with guide rollers 2 guiding a traveling recording medium 1, a recording unit 4 containing line heads performing recording on the recording medium 1, a drying machine 3 for drying the recording medium 1 after recording by the line heads, and a main body frame 5 containing these components. That is, the inkjet recording apparatus 10 is a line head type inkjet recording apparatus having line heads.

Here, as the recording medium 1, a paper, a film, a fabric, a metallic foil, and the like are used, but the recording medium 1 is not limited to these materials.

In addition, the drying machine 3 has a cylindrical dryer, and brings the recording medium 1 after inkjet recording into contact with the surface of the dryer, thereby drying the recording medium 1.

In the inkjet recording apparatus 10, the recording medium introduced thereinto is guided by guide rollers 2 and arrives at the recording unit 4. Then, the recording medium 1 is subjected to inkjet recording by line heads of the recording unit 4.

The recording medium 1 after inkjet recording is guided by another guide roller 2, and arrives at the drying machine 3 and is dried. Thereafter, the recording medium 1 dried is guided by other guide rollers 2 and discharged to the outside.

Figure 2:
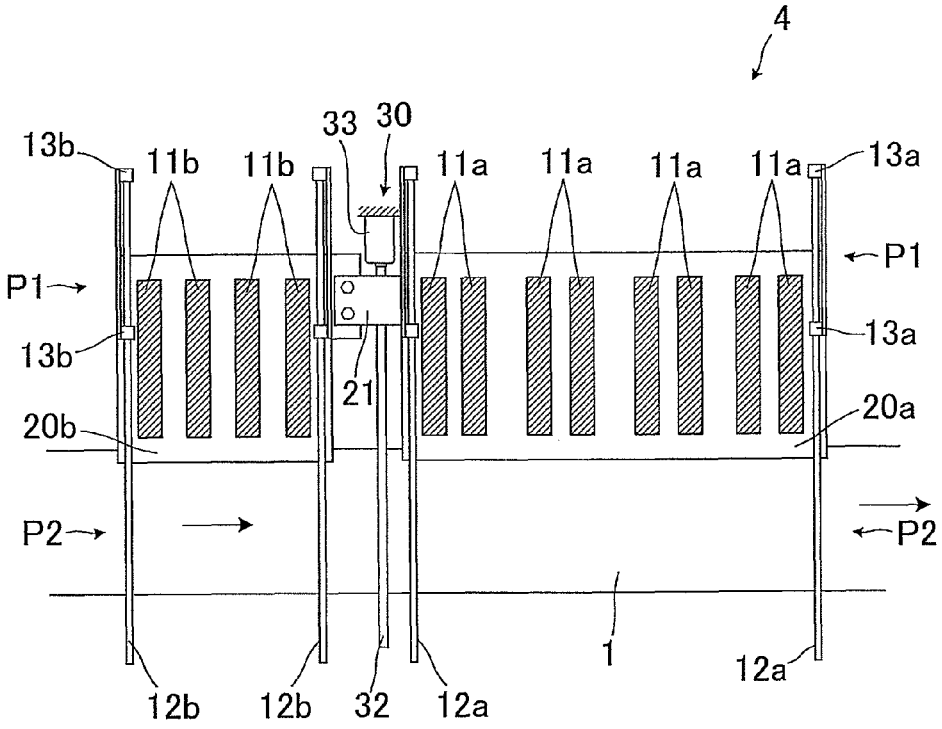
FIG. 2 is a top view showing a recording unit of the inkjet recording apparatus according to the embodiment of the present invention.

FIG. 2 is a top view showing the recording unit of the inkjet recording apparatus according to the embodiment.

As shown in FIG. 2, the recording unit 4 is provided with a first plate 20*a* having four line heads 11*a* arranged thereon, a coupling portion 21 joined to the first plate 20*a*, a drive device 30 sliding the first plate 20*a* via the coupling portion 21 between a waiting position P1 and a recording position P2, a second plate 20*b* having four line heads 11*b* arranged thereon and being attachable to/detachable from the coupling portion 21, and first rails 12*a* and second rails 12*b* attached to the main body frame 5.

Here, the "waiting position P1" means a position where the line heads is made to wait, and is a position separated from the recording medium 1.

In addition, the "recording position P2" means a position where direct recording on the recording medium 1 is performed, and is a position above the recording medium 1.

The four line heads 11*a* which contain respective inks of YMCK inks are arranged on the first plate 20*a*. Therefore, when inkjet recording is performed using only the first plate 20*a*, full-color recording can be performed using the four colors.

In addition, two rows of heads are arranged for each of line heads 11*a* of the first plate 20*a*. That is, two rows of heads are arranged for each color. This makes it possible to double the inkjet recording rate as compared with the inkjet recording rate in the case where each line head has a single row of heads, or makes it possible to double the resolution of inkjet recording.

First sliders 13*a* are attached to both sides of the first plate 20*a* so that the first plate 20*a* slides between the waiting position P1 and the recording position P2 along a pair of first rails 12*a* attached to the main body frame 5 via the first sliders 13*a*. This makes it possible for the first plate 20*a* to slide smoothly to make parallel movement between the waiting position P1 and the recording position P2 without wobbling.

The four line heads 11*b* which contain special inks are arranged on the second plate 20*b*.

In the inkjet recording apparatus 10 according to the embodiment, since the inks of YMCK frequently used and the special inks less frequently used are disposed on different plates, the inks of YMCK and the special inks can be managed separately.

Here, it is possible to set any special ink according to the image data. Examples of such a special ink include an ink having an intermediate color of YMCK, a fluorescent color ink, and an ink having a weather-resistant agent. It should be noted that if it is simply desired that the number of inks of YMCK increases, the inks of YMCK may be used instead of the special inks.

Second sliders 13*b* are attached to both sides of the second plate 20*b* so that the second plate 20*b* slides between the waiting position P1 and the recording position P2 along a pair of second rails 12*b* attached to the main body frame 5 via the second slider 13*b*. This makes it possible for the second plate 20*b* to slide smoothly to make parallel movement between the waiting position P1 and the recording position P2 without wobbling.

In the inkjet recording apparatus 10 according to the embodiment, the coupling portion 21 is integrally joined to the first plate 20*a*.

Then, the second plate 20*b* is attachable to/detachable from the coupling portion 21.

Here, the second plate 20*b* is attached to the coupling portion 21 at two points. Therefore, by attaching the second plate 20*b* to the coupling portion 21, the position of the second plate 20*b* in relation to the first plate 20*a* is determined, and it become possible to align the nozzle positions of the line heads of the first plate 20*a* and the nozzle positions of the line heads of the second plate 20*b* with each other precisely and easily.

For example, by aligning the respective nozzle positions of the line heads of the first plate 20*a* and the second plate 20*b* in a state where the second plate 20*b* has been preliminarily attached to the coupling portion 21, even if attachment and detachment of the second plate 20*b* is repeated thereafter, the second plate 20*b* is positioned when the second plate 20*b* is attached, so that the nozzle positions of the line heads of the first plate 20*a* and the second plate 20*b* are aligned with each other.

Figure 3:
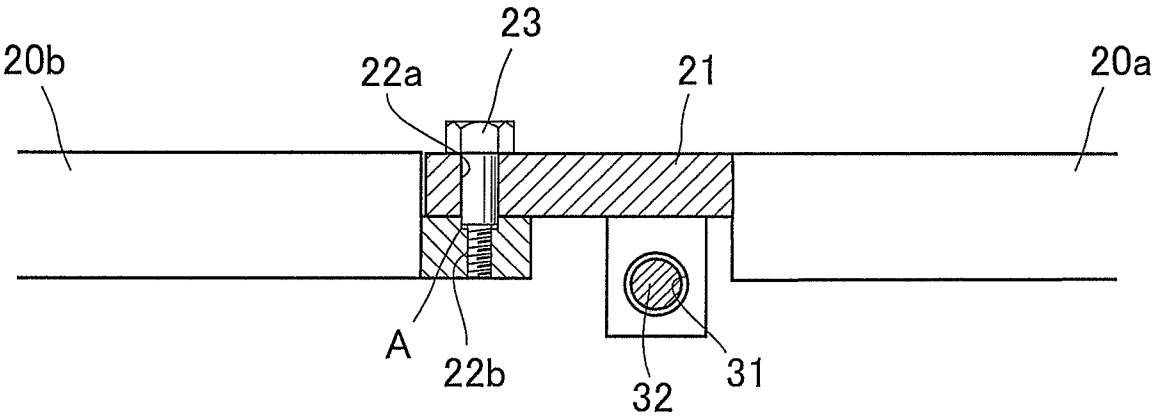
FIG. 3 is a partial sectional view showing the state of coupling between a coupling portion of a first plate and a second plate in the inkjet recording apparatus according to the embodiment of the present invention.

FIG. 3 is a partial sectional view showing the state of coupling between the coupling portion of the first plate, and the second plate in the inkjet recording apparatus according to the embodiment.

In the inkjet recording apparatus 10 according to the embodiment, a pair of first coupling pin holes 22*a* is formed in the coupling portion 21, and a pair of second coupling pin holes 22*b* is formed in the second plate 20*b*.

Then, as shown in FIG. 3, the second plate 20*b* is positioned in relation to the coupling portion 21 by bringing a partial upper face of the second plate 20*b* into contact with a lower face of the coupling portion 21 so as to align the second coupling pin holes 22*b* with the first coupling pin holes 22*a*, and fitting coupling pins 23 into the first and second coupling pin holes 22*a* and 22*b*. Thus, in the inkjet recording apparatus 10, the nozzle positions of the line heads can be aligned more precisely and easily.

Here, the second coupling pin hole 22*b* has stepwise-changed diameters, and the coupling pin 23 also has stepwise-changed diameters so as to correspond to the shape of the second coupling pin hole 22*b*. Therefore, in the inkjet recording apparatus 10, it is easy to position the coupling pins 23 in the first coupling pin holes 22*a* and the second coupling pin holes 22*b*.

In the inkjet recording apparatus 10, the coupling portion 21 is provided with a nut portion 31, and a screw shaft 32 is screwed in the nut portion 31.

Referring back to FIG. 2, the drive device 30 is composed of a ball screw composed of the nut portion 31 attached to the coupling portion 21 and the screw shaft 32 on which the nut portion 31 slides, and a drive motor 33 rotating the screw shaft 32. Therefore, in the inkjet recording apparatus 10, since the ball screw is used, it becomes possible to slidingly place the first plate 20*a* precisely at a desired position.

In the inkjet recording apparatus 10, when the drive motor 33 is driven, the screw shaft 32 rotates, and via the nut portion 31 screwed thereon the coupling portion 21 slides. At this time, according to the direction of rotation of the screw shaft 32, the coupling portion 21 advances or retreats.

In the inkjet recording apparatus 10 according to the embodiment, when inkjet recording is not performed, the first plate 20*a* and the second plate 20*b* are disposed in the waiting positions P1.

Here, though not shown in FIG. 2, the waiting position P1 is provided with caps attachable to nozzle portions of the line heads. It should be noted that a method of attaching the caps to the nozzle portions will be described later.

Figure 4:
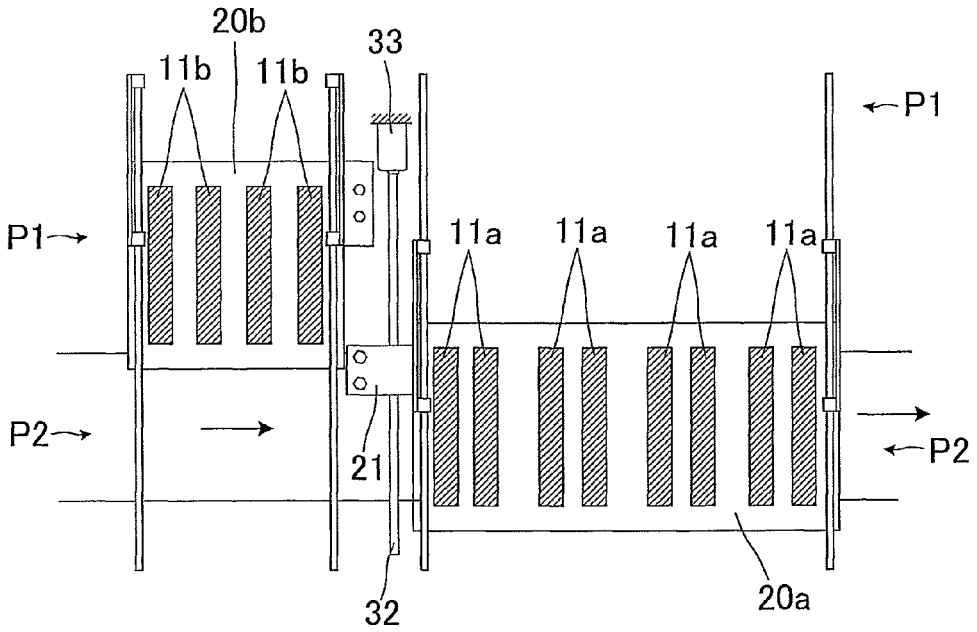
FIG. 4 is a top view showing schematically a state that only the first plate has been slid in the inkjet recording apparatus according to the embodiment of the present invention.

FIG. 4 is a top view showing schematically a state that only the first plate has been slid in the inkjet recording apparatus according to the embodiment.

As shown in FIG. 4, in the inkjet recording apparatus 10 according to the embodiment, when the second plate 20*b* is detached from the coupling portion 21, the screw shaft 32 is rotated by driving the drive motor 33, and only the first plate 20*a* integral with the coupling portion 21 slides from the waiting position P1 to the recording position P2.

At this time, the four line heads 11*a* attached to the first plate 20*a* makes it possible to perform full-color inkjet recording using the respective inks of YMCK. It should be noted that the nozzle portions of the four line heads 11*b* attached to the unused second plate 20*b* are covered with the caps in order to prevent drying.

Figure 5:
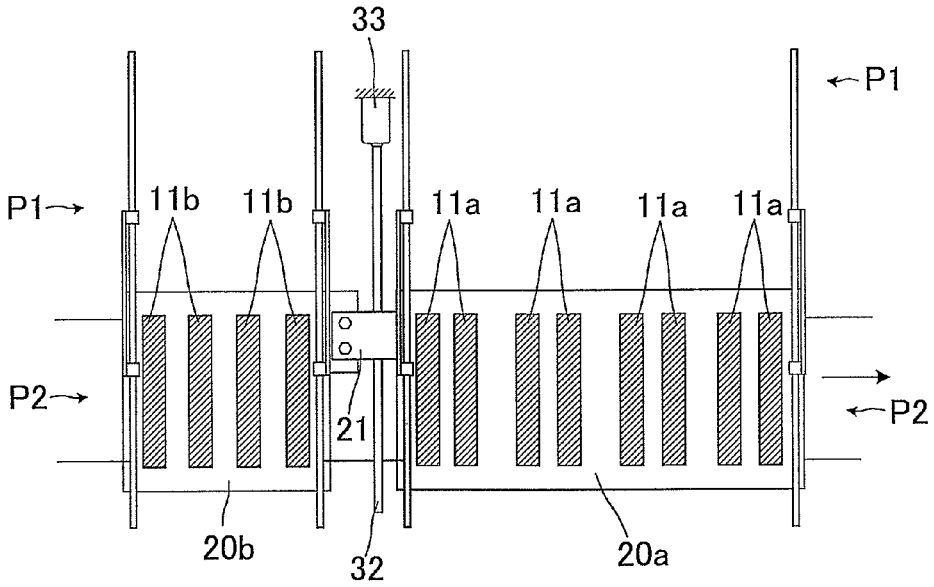
FIG. 5 is a top view showing schematically a state that the first plate and the second plate has been slid in the inkjet recording apparatus according to the embodiment of the present invention.

FIG. 5 is a top view showing schematically a state that the first plate and the second plate have been slid in the inkjet recording apparatus according to the embodiment.

As shown in FIG. 5, in the inkjet recording apparatus 10 according to the embodiment, when the second plate 20*b* is attached to the coupling portion 21, the screw shaft 32 is rotated by driving the drive motor 33 so that the first plate 20*a* integral with the coupling portion 21 and the second plate 20*b* positioned by the coupling portion 21 and attached thereto are slid from the waiting positions P1 and the recording positions P2. That is, the first plate 20*a* and the second plate 20*b* are integrally slid.

In this case, in addition to full-color inkjet recording performed using the respective inks of YMCK by the four line heads 11*a* attached to the first plate 20*a*, it becomes possible to perform inkjet recording using the special inks by the four line heads 11*b* attached to the second plate 20*b*.

Thus, in the inkjet recording apparatus 10 according to the embodiment, since it is possible to switch between a pattern in which inkjet recording is performed using the first plate 20*a* and a pattern in which inkjet recording is performed using the first plate 20*a* and the second plate 20*b*, the number of line heads used can be adjusted according to the image data.

In addition, since the first plate 20*a* and the second plate 20*b* are driven by a single drive shaft, the nozzle position of the line head 11*a* of the first plate 20*a* and the nozzle position of the line head 11*b* of the second plate 20*b* can be aligned with each other extremely precisely and easily.

Figure 6:
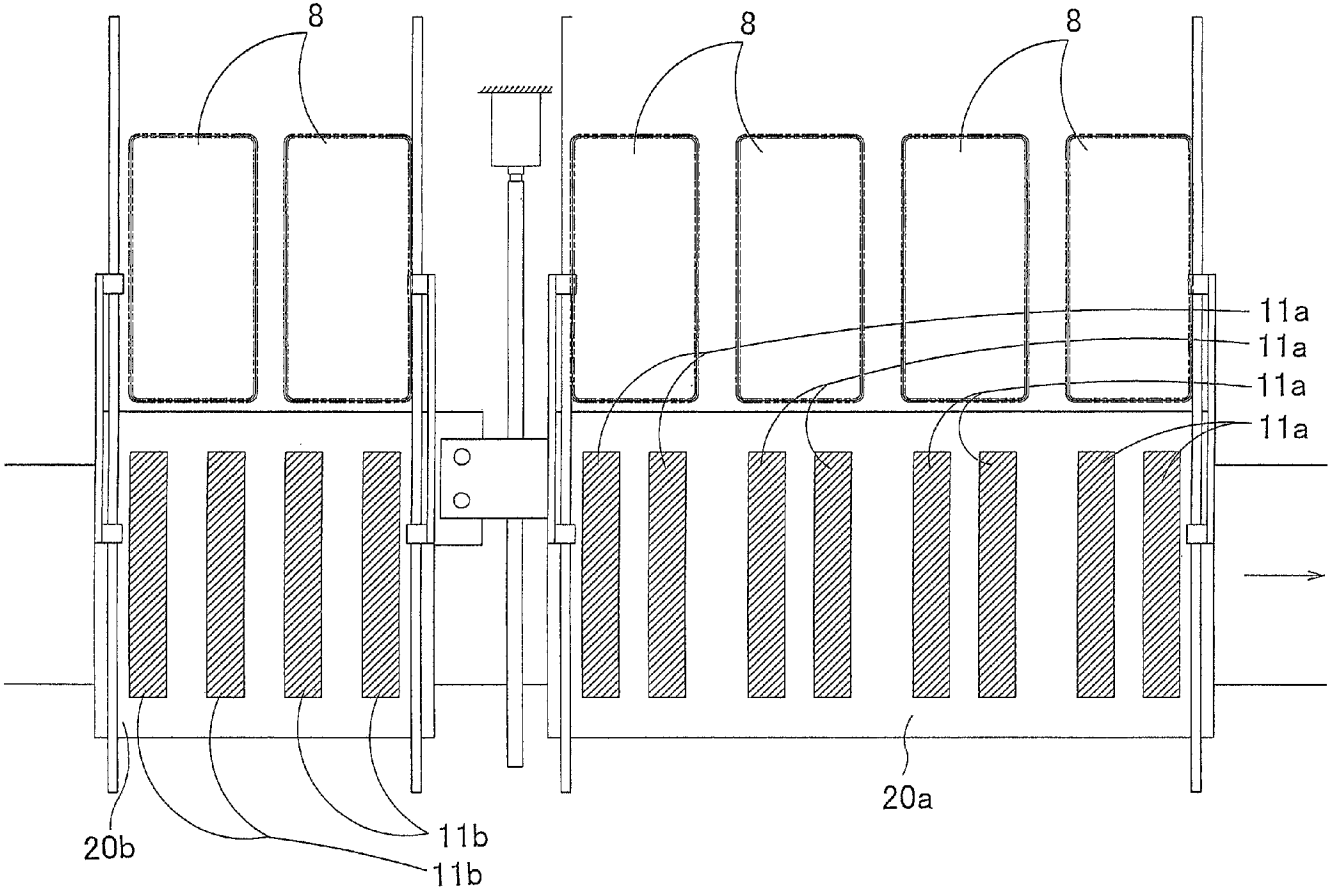
FIG. 6 is a top view schematically showing caps in the inkjet recording apparatus according to the embodiment of the present invention.

FIG. 6 is a top view schematically showing caps 8 in the inkjet recording apparatus according to the embodiment.

As shown in FIG. 6, the caps 8 are disposed in the waiting positions P1 so as to correspond to the number of the line heads 11*a* of the first plate 20*a* and the number of the line heads 11*b* of the second plate 20*b*.

Then, in the waiting positions P1, the caps 8 can be attached to the nozzle portions of the line heads 11*a* and 11*b*.

Figure 7A:
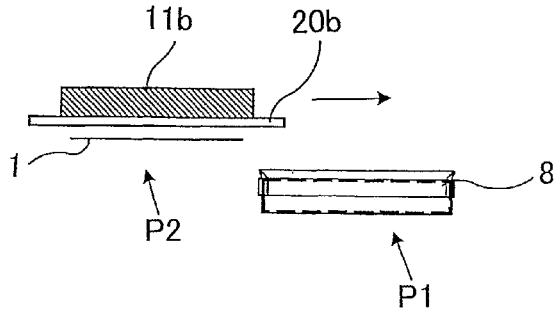
FIGS. 7A to 7C are side views for explaining the method of attaching/detaching the cap to/from the line head in the inkjet recording apparatus according to the embodiment of the present invention.
Figure 7B:
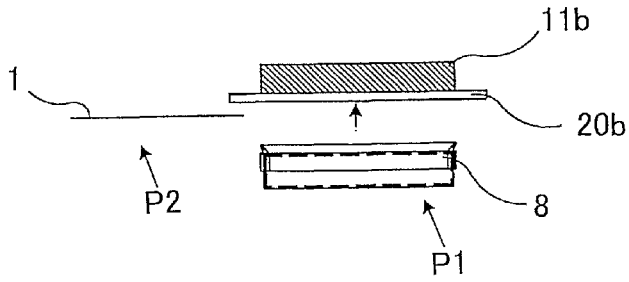
Figure 7C:
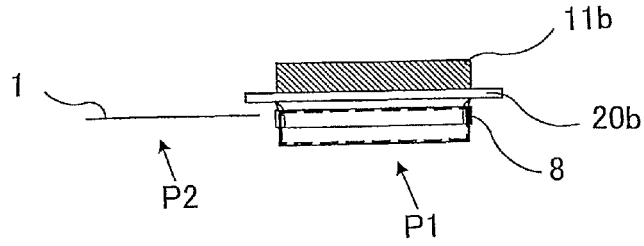

FIGS. 7A to 7C are side views for explaining the method of attaching/detaching the cap to/from the line head in the inkjet recording apparatus according to the embodiment.

First, as shown in FIG. 7A, the second plate 20*b* is slid to the waiting position P1 from the recording position P2, and, as shown in FIG. 7B, the second plate 20*b* is disposed so as to position the line head 11*b* above the cap 8.

Then, the cap 8 is raised and attached to the nozzle portion of the line head 11*b*.

In the inkjet recording apparatus 10, since the unused line head 11*b* is disposed in the waiting position P1, and the nozzle portion thereof is covered with the cap, the ink contained in the unused line head 11*b* can be prevented from drying, so that the nozzle portion can be prevented from clogging.

It should be noted that when the first plate 20*a* is not used, the caps 8 can be attached to the line heads 11*a* in the same matter as described above.

In addition, it is possible to slide the first plate 20*a* and the second plate 20*b* simultaneously, thereby attaching the caps 8 to the corresponding line head 11*a* and the line head 11*b* simultaneously.

Hereinabove, the embodiment of the present invention has been described, but the present invention is not limited to the above embodiment.

For example, the inkjet recording apparatus 10 according to the embodiment is provided with the drying machine 3 heating and drying the recording medium 1 after printing, but the present invention is not limited to this. For example, a recording medium after printing may be dried by a separate drying machine.

In the inkjet recording apparatus 10 according to the embodiment, the four line heads 11*a* are arranged on the first plate 20*a*, but the line heads may be one to three in number, or may be five or more in number. In addition, the four line heads 11*a* contain respective inks of YMCK, but the present invention is not limited to this.

Similarly, the four line heads 11*b* are arranged on the second plate 20*b*, but the line heads may be one to three in number, or may be five or more in number.

In the inkjet recording apparatus 10 according to the embodiment, two rows of heads are arranged for each of the line heads 11*a* of the first plate 20*a*, but a single row of head may be arranged, or three or more rows of heads may be arranged.

Further, a row of head is arranged for each of the line heads 11*b* of the second plate 20*b*, but two or more rows of heads may be arranged.

In the inkjet recording apparatus 10 according to the embodiment, the coupling portion 21 is integrally jointed to the first plate 20*a*, but the first plate 20*a* and the coupling portion 21 may be members separated from each other.

In the inkjet recording apparatus 10 according to the embodiment, the second plate 20*b* is attached to the coupling portion 21 at two points, but the second plate 20*b* may be attached thereto at a single point, or may be attached thereto at three or more points.

In the inkjet recording apparatus 10 according to the embodiment, the partial upper face of the second plate 20*b* is brought into contact with the lower face of the coupling portion 21 (see FIG. 3), but a space may be present therebetween.

Further, by fitting the coupling pins 23 into the first coupling pin holes 22*a* and the second coupling pin holes 22*b*, the second plate 20*b* is attached to the coupling portion 21, but a mechanism for the attaching is not limited to this configuration.

In the inkjet recording apparatus 10 according to the embodiment, the ball screw is used as the drive device, but a linear motor, a common screw shaft, or the like may be used.

In the inkjet recording apparatus 10 according to the embodiment, the waiting position P1 is provided with a cap attachable to the nozzle portion of the line head, but the cap itself may be a member separated therefrom.

Industrial Applicability

The inkjet recording apparatus of the present invention can be used as a line head type inkjet recording apparatus that uses a line head to perform recording on a recording object. According to such an inkjet recording apparatus, the number of line heads can be adjusted, and the nozzle positions of the line heads can be aligned precisely and easily.

REFERENCE SIGNS LIST

1 . . . recording medium
2 . . . guide roller
3 . . . drying machine
4 . . . recording portion
5 . . . main body frame
10 . . . inkjet recording apparatus
11*a*, 11*b* . . . line head
12*a* . . . first rail
12*b* . . . second rail
13*a* . . . first slider
13*b* . . . second slider
20*a* . . . first plate
20*b* . . . second plate
21 . . . coupling portion
22*a* . . . first coupling pin hole
22*b* . . . second coupling pin hole
23 . . . coupling pin
30 . . . drive device
31 . . . nut portion
32 . . . screw shaft
33 . . . drive motor
P1 . . . waiting position
P2 . . . recording position

The invention claimed is:

1. An inkjet recording apparatus comprising:

a first plate having a plurality of line heads arranged thereon;

a coupling portion jointed to the first plate;

a drive device for sliding the first plate via the coupling portion in a direction perpendicular to a main scanning direction from a waiting position in which the line heads wait to a recording position in which recording is performed on a recording medium;

a second plate having at least one line head arranged thereon and being attachable to and detachable from the coupling portion;

a main body frame;

a pair of first rails attached to the main body frame;

a pair of second rails attached to the main body frame;

at least one first coupling pin hole formed in the coupling portion; and at least one second coupling pin hole formed in the second plate, wherein the first plate is independently slidable in the direction perpendicular to the main scanning direction, along the first pair of rails, when the second plate is detached from the coupling portion, the first and second plates are integrally slidable along the pair of first and second rails, respectively, when the second plate is attached to the coupling portion and the position of the second plate is determined in the direction perpendicular to the main scanning direction in relation to the first plate by fitting coupling pins into the first and second pin holes when they are aligned with each other.

2. The inkjet recording apparatus according to claim 1, wherein the second plate and the coupling portion are attached to each other at two points.

3. An inkjet recording apparatus comprising:

a first plate having a plurality of line heads arranged thereon;

a coupling portion jointed to the first plate;

a drive device for sliding the first plate via the coupling portion in a direction perpendicular to a main scanning direction from a waiting position in which the line heads wait to a recording position in which recording is performed on a recording medium;

at least one first coupling pin hole formed in the coupling portion; and at least one second coupling pin hole formed in the second plate;

wherein the first plate is independently slidable in the direction perpendicular to the main scanning direction when the second plate is detached from the coupling portion, the first and second plates are integrally slidable in the direction perpendicular to the main scanning direction when the second plate is attached to the coupling portion and the position of the second plate is determined in the direction to the main scanning direction in relation to the first plate by fitting coupling pins into the first and second pin holes when they are aligned with each other.

4. The inkjet recording apparatus according to claim 3, wherein the second plate and the coupling portion are attached to each other at two points.

* * * * *